US005683339A

United States Patent [19]

Mills et al.

[11] Patent Number: 5,683,339

[45] Date of Patent: Nov. 4, 1997

[54] CONTAINER FABRICATION METHOD

[76] Inventors: Vincent Mills, 348 Forest Dr. SE., Cedar Rapids, Iowa 52403; Tim P. Hughes, 2611 30th St. SW., Cedar Rapids, Iowa 52404

[21] Appl. No.: 747,774

[22] Filed: Nov. 13, 1996

Related U.S. Application Data

[62] Division of Ser. No. 541,943, Oct. 10, 1995, Pat. No. 5,588,943, which is a division of Ser. No. 215,173, Mar. 21, 1994, Pat. No. 5,482,204.

[51] Int. Cl.[6] ..... B31B 1/88

[52] U.S. Cl. ..... 493/58; 493/156; 53/376.6; 53/374.2; 53/563

[58] Field of Search ..... 493/58, 141, 121, 493/156, 160, 473, 468, 295, 165, 184; 53/376.6, 377.6, 563, 374.2; 156/581

[56] References Cited

U.S. PATENT DOCUMENTS

| | | |
|---|---|---|
| 2,677,318 | 5/1954 | Torudd et al. . |
| 3,120,335 | 2/1964 | Egleston et al. . |
| 3,144,192 | 8/1964 | Seline, Jr. . |
| 3,163,350 | 12/1964 | Zinn . |
| 3,285,143 | 11/1966 | Baker . |
| 3,406,892 | 10/1968 | Egleston et al. . |
| 3,679,123 | 7/1972 | Wood . |
| 3,693,315 | 9/1972 | Segel et al. . |
| 3,947,205 | 3/1976 | Edwards . |
| 3,971,300 | 7/1976 | Bachner . |
| 3,998,378 | 12/1976 | Vetten . |
| 4,011,800 | 3/1977 | Walke . |
| 4,057,444 | 11/1977 | Prot . |
| 4,127,059 | 11/1978 | Richards . |
| 4,284,228 | 8/1981 | Cetrelli . |
| 4,380,447 | 4/1983 | Vanderlugt, Jr. . |
| 4,430,142 | 2/1984 | Ochi et al. . |
| 4,558,814 | 12/1985 | Ihde . |
| 4,991,768 | 2/1991 | Kondo . |
| 5,029,751 | 7/1991 | Detzel . |
| 5,090,180 | 2/1992 | Sorensen . |
| 5,222,667 | 6/1993 | Fujikawa et al. . |
| 5,324,250 | 6/1994 | Janson et al. . |
| 5,482,204 | 1/1996 | Mills et al. . |

FOREIGN PATENT DOCUMENTS

| | | |
|---|---|---|
| 99649 | 2/1984 | European Pat. Off. . |
| 0106215 | 4/1984 | European Pat. Off. . |
| 0281206 | 9/1988 | European Pat. Off. . |

*Primary Examiner*—John Sipos
*Assistant Examiner*—John Paradiso
*Attorney, Agent, or Firm*—Luedeka Neely & Graham, P.C.

[57] ABSTRACT

The bottom of a paperboard container of the type suitable for consumer distribution of liquid foods such as milk and fruit juice includes an embossed concavity to reinforce the bottom against bulging under content fill pressure for improved free-standing stability. The carton bottom concavity is embossed to approximate the shape of a stepped pyramid.

2 Claims, 7 Drawing Sheets

CONTAINER FABRICATION METHOD

This application is a division of application Ser. No. 08/541,943 filed Oct. 10, 1995 and now U.S. Pat. No. , 5,588,943 issued Dec. 31, 1996. Said application Ser. No. 08/541,943 was a division of application Ser. No. 08/215,173 filed Mar. 21, 1994 and now U.S. Pat. No. 5,482,204 issued Jan. 9, 1996.

BACKGROUND OF THE INVENTION

This invention relates to paperboard containers of the type suitable for liquid food products such as milk and fruit juices, and more particularly relates to a paperboard container for liquid food products which exhibits improved upright standing stability when filled.

Liquid tight containers suitable for distributing consumer quantities of liquid food products are frequently fabricated from paperboard sheets coated with a film of heat sealable, waterproof thermoplastic such as polyethylene, polyvinyl chloride or polypropylene. These plastic coated sheets are cut into blanks which are first folded into four-sided tubes and then closed by a lap fold of bottom panels extending integrally from the four side walls. While the plastic film coating is still hot and tacky, the bottom wall lap panels are fused together by a bottom sealing die.

Paperboard containers for liquid food products have an inherent instability due to the pressure exerted on the walls by the fluid, particularly the bulging effect of the fluid on the bottom. The degree of bulging is a function of the stiffness of the board, i.e., stiffer board exhibits less bulging. Thus, one way to address a bulging problem is to use a stiffer board. However, increasing the stiffness often comes at the cost of other board properties and a stiffer board is generally more difficult to fold and assemble into the erected container. Stiffer boards also tend to be more expensive, which drives up the cost of the container.

These and other problems have limited progress toward achieving an economical carton bottom construction with a minimum of center bulging and improved stability.

It is therefore an object of the present invention to provide a method of forming lapped bottom panels of a paperboard fluid carton into a support surface of improved stability.

Another object of the present invention is to provide a paperboard carton bottom which is stiffened against center bulging from fluid content pressure.

A further object of the invention is to provide an economical paperboard carton bottom construction of improved stability.

SUMMARY OF THE INVENTION

Having regard to the above and other objects and advantages, the present invention is directed to a paperboard fluid carton having a bottom support surface with improved stability and to a method and apparatus for making the carton. In accordance with its more general aspects, the invention relates to a method of making a paperboard liquid container having a lapped panel bottom wall wherein the lapped panel bottom wall of the paperboard liquid container is pressingly engaged between a pair of concave/convex dies to deform the bottom wall into a stepped approximation of a lenticular profile. As viewed from the bottom, the result is a concave, stepped pyramid formed into multiple tiers of lapped layers. A narrow outer rim area supports the container weight and the remainder of the bottom wall structure is displaced above the rim plane area into the interior of the container.

BRIEF DESCRIPTION OF THE DRAWINGS

The foregoing and other features of the invention will become further known from the following detailed description of preferred embodiments of the present invention in conjunction with the accompanying drawings in which.

DESCRIPTION OF THE PREFERRED EMBODIMENT

Figure 1:
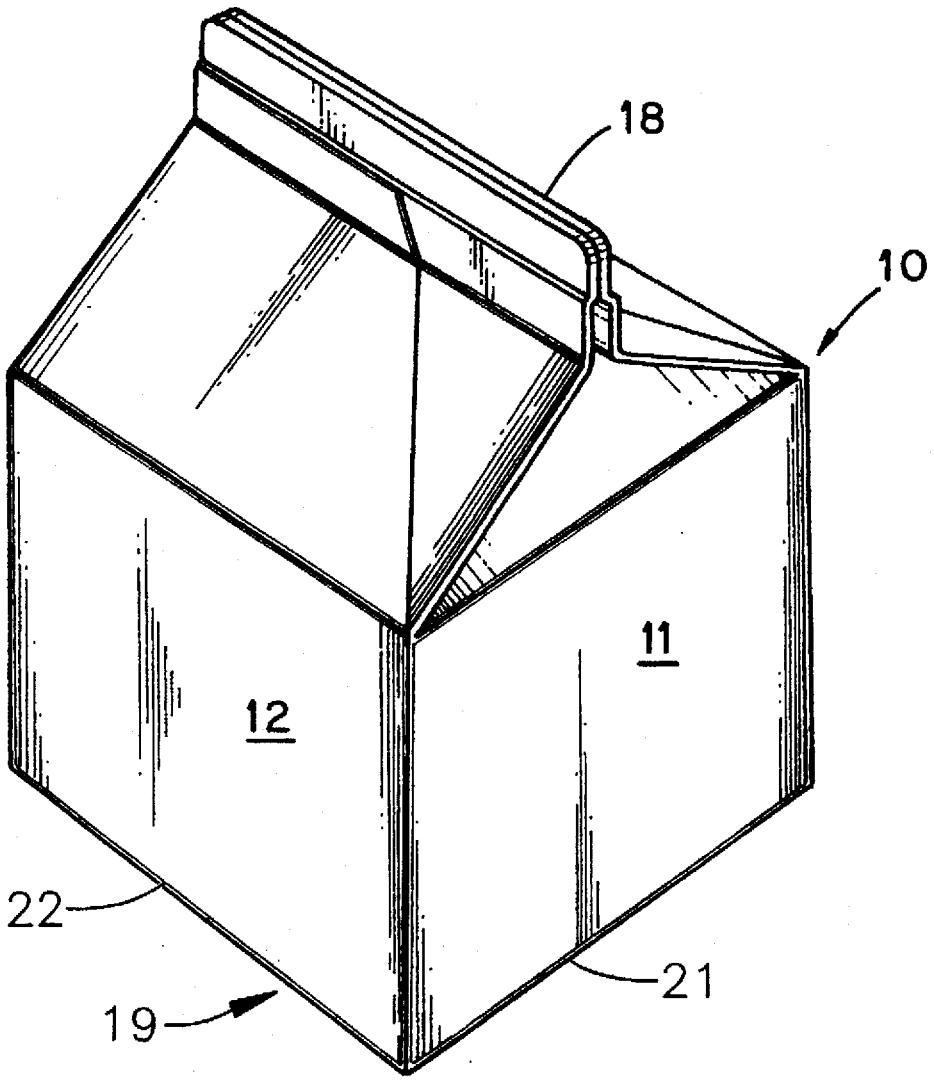
FIG. 1 is a pictorial illustration of a gable top paperboard beverage container typical of the type to which the present invention relates.

Referring now to the drawings in which like reference characters designate like or similar parts throughout the several views, FIG. 1 illustrates a liquid container 10 of the type contemplated by the present invention. Such a container is folded from a single, continuous blank such as that illustrated by FIG. 2 which includes four parallel walls 11, 12, 13 and 14 joined by a longitudinally running lap seam tab 15. This development provides a four-walled tube which is folded to a lapped panel gable closure at the top 18 and to a lapped panel bottom wall 19 at the bottom end.

Although a gable top closure is referenced herein, this is only exemplary of various closure styles. The particular top closure configuration is not germane to the present invention. Some paperboard containers are closed with a flat top wall similar to the bottom.

Figure 2:
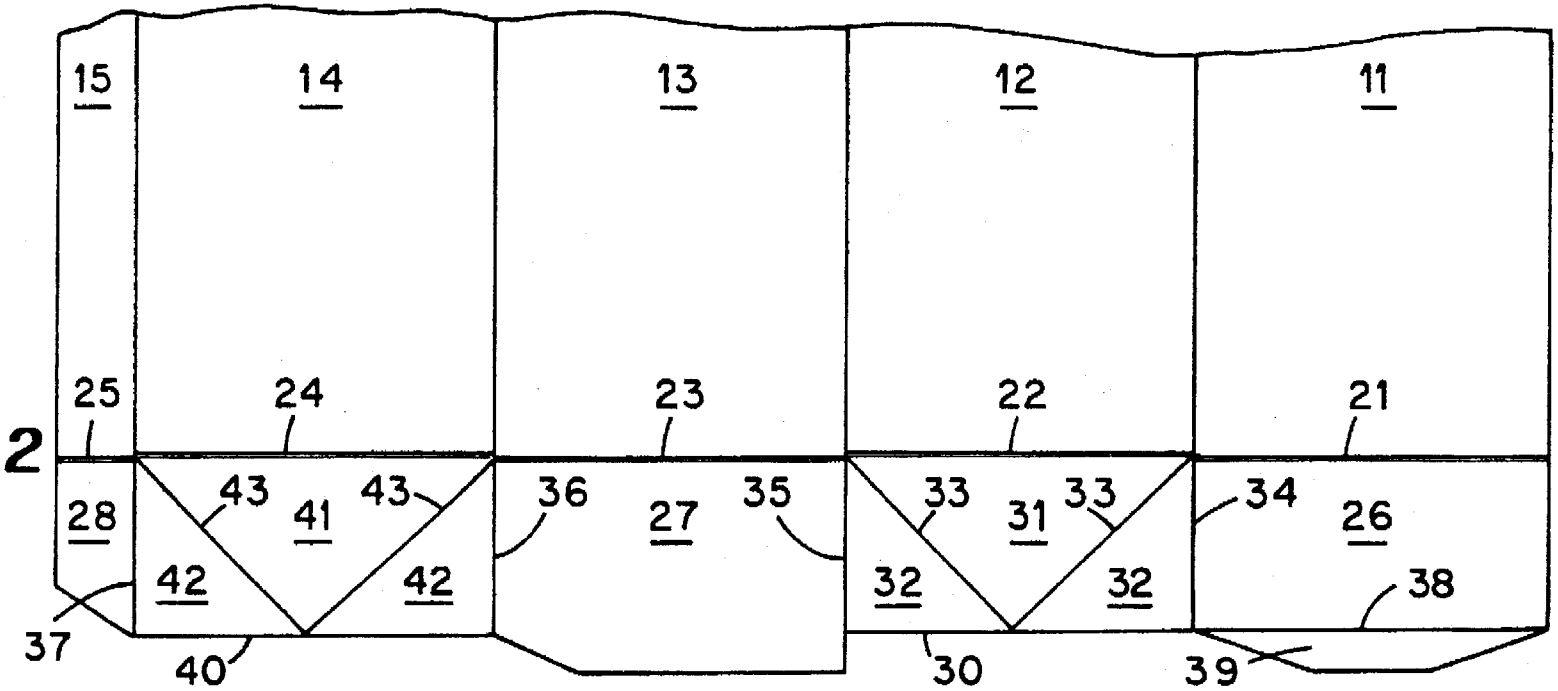
FIG. 2 is the lower portion of a paperboard sheet blank appropriate for erecting paperboard beverage containers.

Since the invention is focused on the bottom closure of a folded paperboard tube, the blank sheet plan of FIG. 2 is limited to showing only the fold score lines and lap panels for a bottom wall composition.

It will first be noted that all of the FIG. 2 blank is a continuous, integral sheet or board which has been previously coated with one or more continuous films of thermoplastic polymer or otherwise adapted through incorporation of layers, laminants and/or treatments as may be necessary to confer the properties required for the end use. The lines shown thereon represent fold score lines which are basically creases that have been produced in the board as by passage of the board through the nip of a pair of creasing dies, or placement between creasing plates, for example. No slits or cuts are represented interiorly from the blank periphery.

Accordingly, score line 21 divides the side panel 11 from the bottom panel 26 and becomes the bottom corner common to the two intersecting panels. Similarly, fold score line 22 divides the side wall 12 from the bottom panel 30 which is further divided into triangular panels 31 and 32 separated by fold lines 33. Fold score 23 delineates the side wall 13 from the bottom panel 27. As before, side wall 14 is delineated by fold score line 24 from the bottom panel 40 and panel 40 is further divided into triangular panels 41 and 42, each separated by fold lines 43. Fold line 25 separates the lap seam tab 15 from the bottom tab 28 and, in assembly, overlies a portion of the score line 21. Fold lines 21, 22, 23 and 24 together define the bottom plane of the carton, with fold line 25 being tucked into the container upon assembly.

Figure 3:
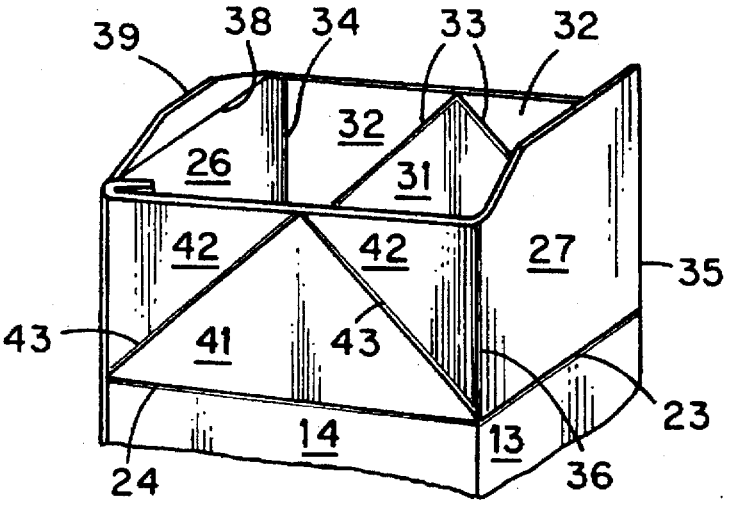
FIGS. 3, 4 and 5 pictorially illustrate the typical folding sequence for forming a lapped panel bottom wall.
Figure 4:
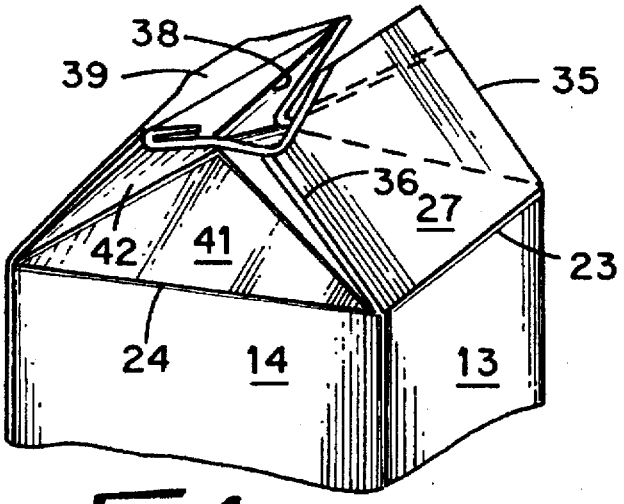
Figure 5:
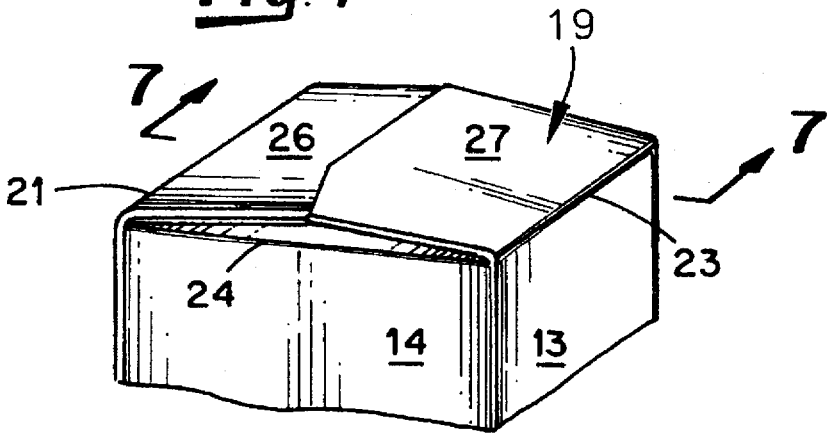

The lap folding sequence of these several bottom panels is illustrated by collective reference to FIGS. 3, 4 and 5.

FIG. 3 shows the open tube with only the side wall corners erected by a heat fused bonding of the lap seam tabs 15 and 28 to the inside surface portions of side wall 11 and bottom panel 26.

A bottom closure sequence is initiated by an inward folding of the triangular panels 41 and 31 about bottom fold lines 22 and 24. Corner panels 32 and 42 simultaneously rotate about score lines 33 and 43, respectively.

Figure 7:
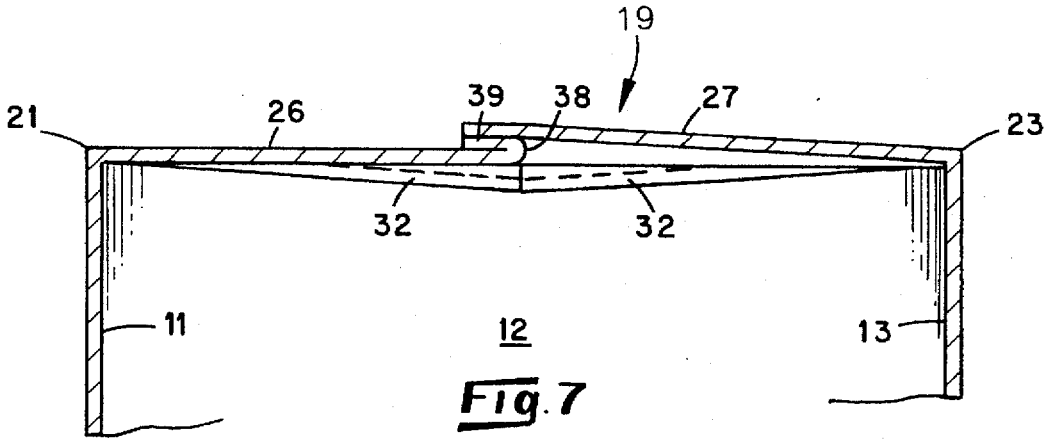
FIG. 7 is a sectional elevation of the lapped panel bottom wall illustrated by FIG. 6 as viewed along the cutting plane 7—7 of FIG. 6.
Figure 6:
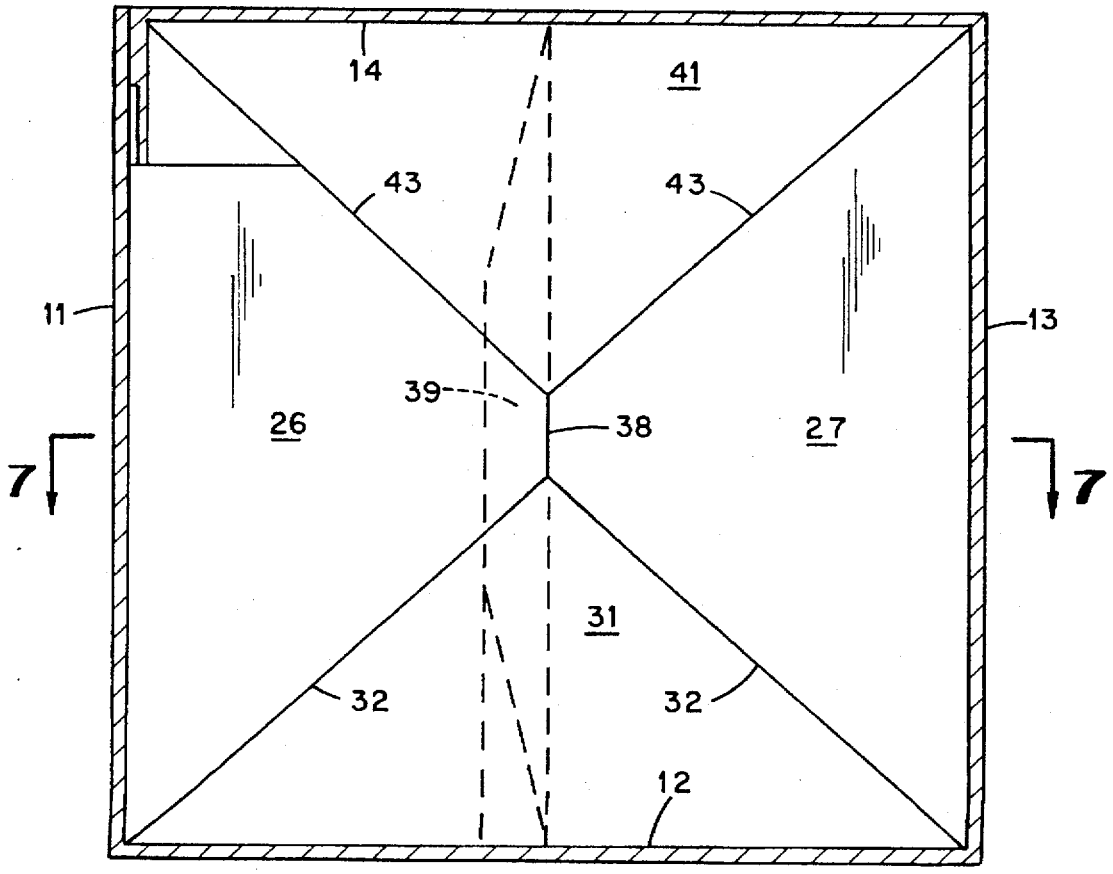
FIG. 6 is an interior plan view of a lap folded bottom wall of a paperboard liquid container.

As the container bottom wall panels are simultaneously folded upon themselves, end panel 39 is rotated about score line 38 as shown in FIG. 4 against the outside surface of bottom panel 26. The end result is seen in FIG. 7 which shows the various bottom panels folded flat to form the bottom surface but in an expanded, uncompressed position.

Although paperboard container blanks may be assembled by adhesive, more frequently such paperboard blanks are secured in the erect position by hot fuse bonds between adjacent polymer coatings at the panel lapping interfaces. Such is the material state when the open tube is received over the concave die block 50 illustrated by FIG. 10. In that position the end panels are folded down against themselves and against the upper face of the die block shown by FIG. 11.

Convex die block 60 is then brought against the exterior face of the lapped panel bottom wall to pressingly engage the several folds in the lapped assembly tightly against themselves between the dies and to fuse the juxtaposed plastic films together.

Figure 11:
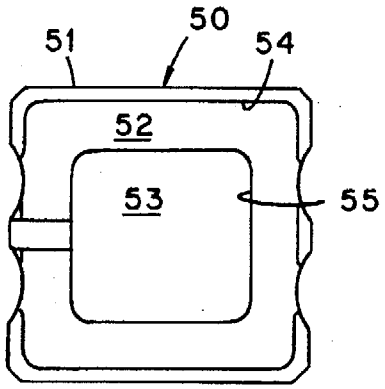
FIG. 11 is a top plan view of the concave embossing die of FIG. 10.
Figure 10:
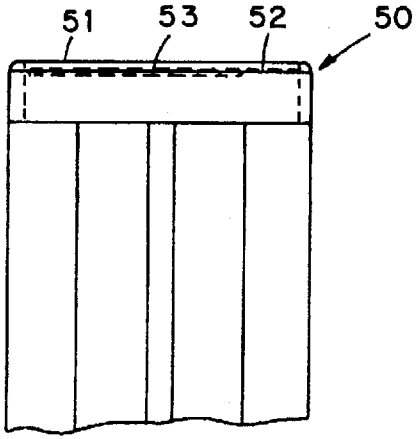
FIG. 10 is an elevational view of a concave embossing die suitable for practice of the present invention.
Figure 14:
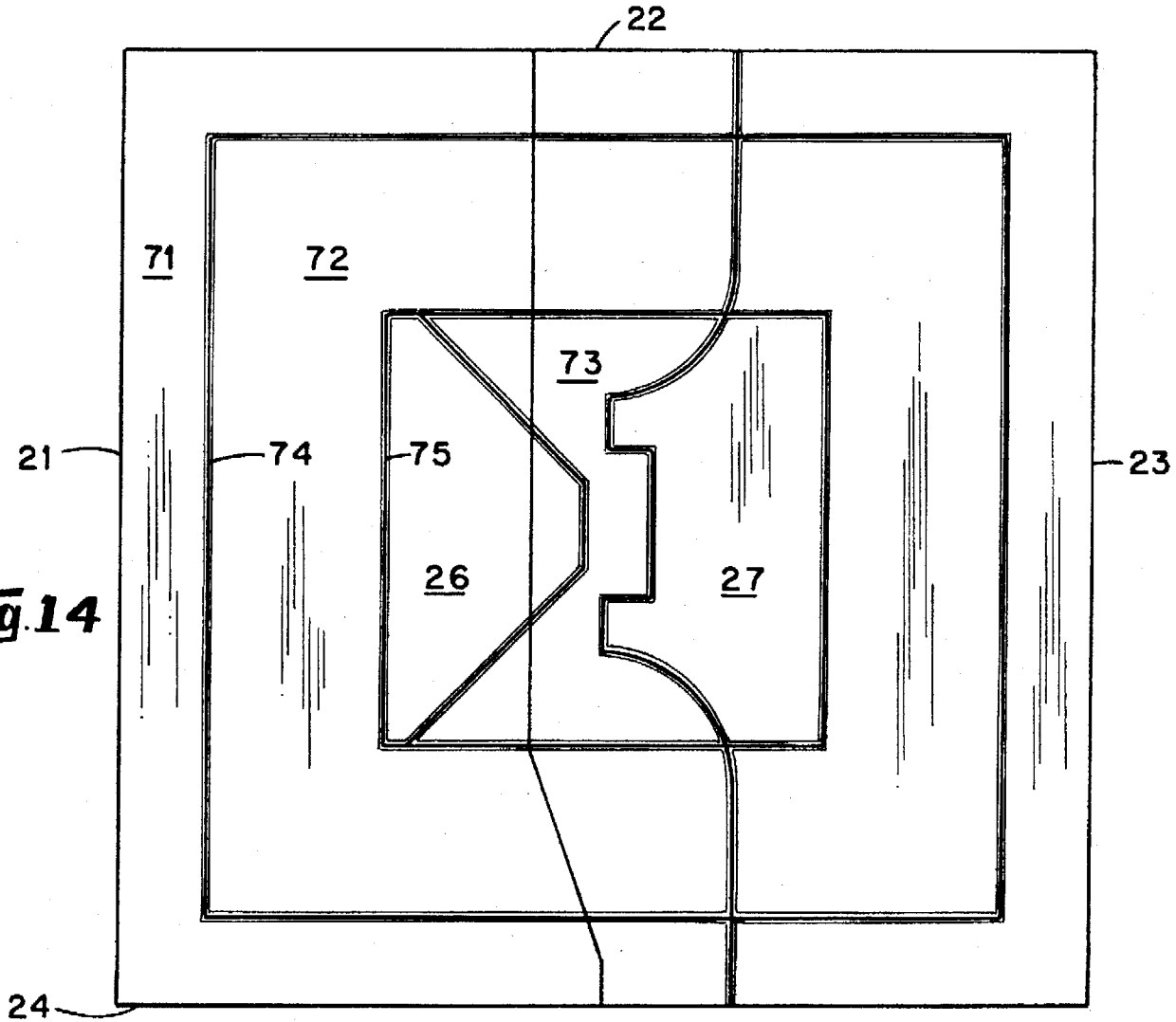
FIG. 14 is an external surface bottom plan view of a paperboard fluid container embossed in accordance with the teachings of the present invention.

It will also be noted from FIGS. 10 and 11 that concave die 50 has its respective area divided into three segments 51, 52 and 53, each corresponding to a respective level in a step tiered sequence separated by surface discontinuity ridges 54 and 55 of progressively deeper rectangular recesses, one within the other, moving inwardly as viewed in FIG. 11.

Figure 12:
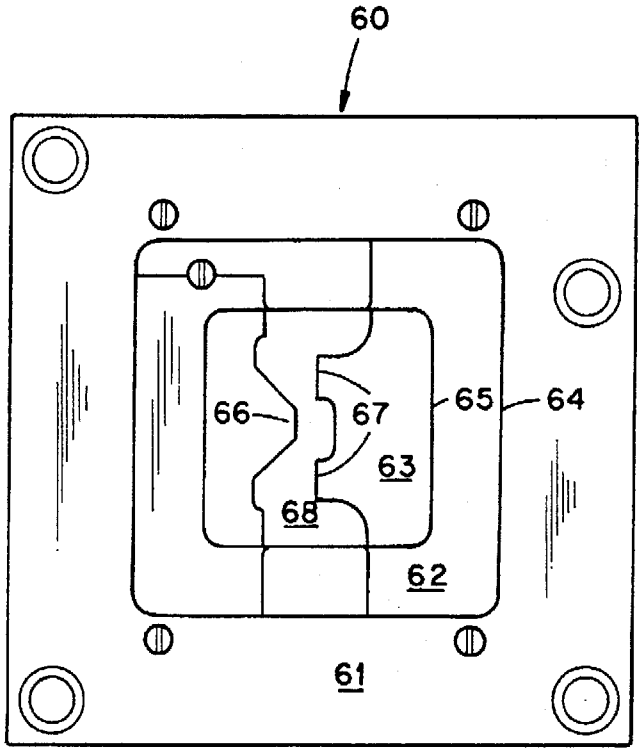
FIG. 12 is a top plan view of a convex embossing die suitable for practice of the present invention.
Figure 13:
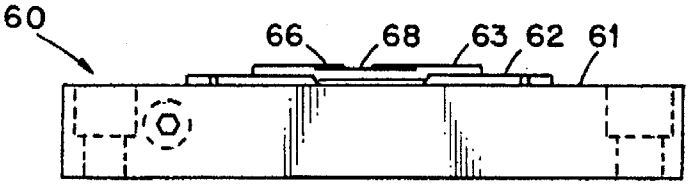
FIG. 13 is an elevational view of the convex embossing die of FIG. 12.

The corresponding convex die 60 illustrated by FIGS. 12 and 13 provides concentrically diminishing areas 61, 62 and 63 in a stepped sequence of progressively higher rectangular projections, one within the other, moving inwardly as viewed in FIG. 12, with riser ridge lines 64 and 65 separating areas 61 and 62 and areas 62 and 63, respectively. The innermost tier surfaces 62 and 63 are vented with an air escape channel 68 between a chevron point 66 and a pair of denticulated fingers 67. This chevron/finger geometry has been found effective to smoothly distribute the sealing pressure as five thicknesses of paperboard are compressed to the dimension of two thickness. As the convex die block 60 advances into the recess of the concave die block 50 air between the folds and within the paperboard compositional matrix is rapidly displaced and forced from the final volume occupied by the bottom wall panel. Vent channel 68 provides an escape route for this sudden rush of gas which would otherwise cause a wave in the overlapping material panels. Without the vent channel 68, the material wave would collapse into a wrinkle in one or more of the bottom forming panels to prevent a fluid tight seal between the several panel faces.

Figure 9:
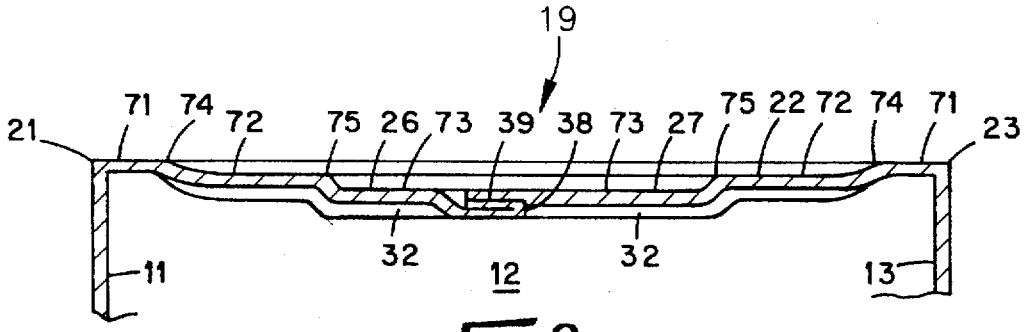
FIG. 9 is a sectional elevation of the lapped panel bottom wall illustrated by FIG. 8 as viewed along the cutting plane 9—9 of FIG. 8.
Figure 8:
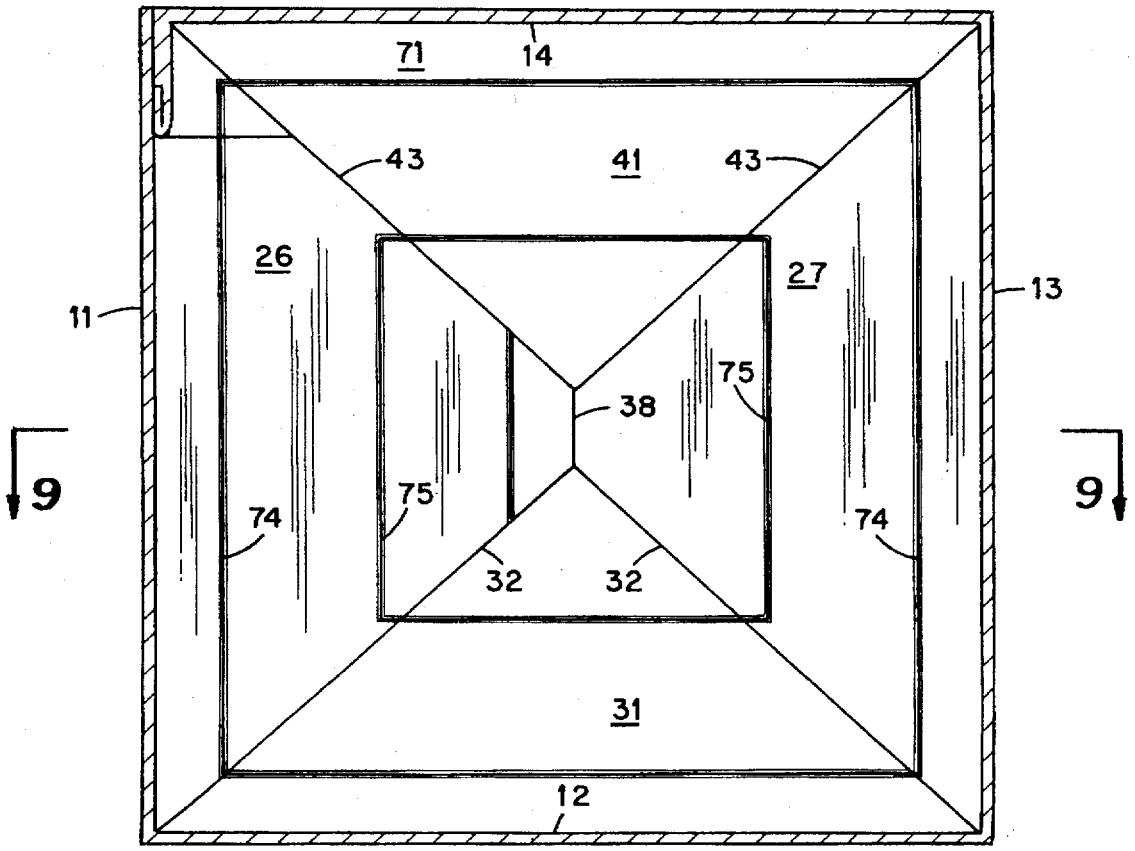
FIG. 8 is an interior plan view of a lapped panel end wall of a paperboard liquid container having an embossed concave exterior surface profile.

The bottom section profile of FIG. 9 illustrates the compacted result of this high pressure die embossment which shows the formation of a stepped platform or pyramid having a rim plane 71, a first step plane 72 and a second step plane 73. Step planes 71 and 72 are separated by an outer embossed relief line 74. Step planes 72 and 73 are separated by an inner embossed relief line 75.

Convex displacement of the bottom wall panel interior area leaves the bottom corners defined by the fold score lines 21, 22, 23 and 24 in the same perimeter plane including the narrow rim surface area 71. The remaining bottom wall surface area approximates a lenticular dish which thrusts the fluid weight of the container contents against the bottom corner walls thereby resisting an external bulging of the bottom wall profile which contributes to the standing stability of the carton.

Having fully disclosed my invention, we claim:

1. A method of fabricating a fluid-tight container from an integral sheet of thermoplastic film coated paperboard comprising the steps of:

folding a tubular enclosure having four side walls laterally delineated by substantially parallel corners;

forming a fluid-fight bottom wall that is substantially perpendicular to said tubular enclosure corners with bottom peels that are materially integral extensions of said side walls, by lap folding said bottom panels;

sealing said bottom panels fluid-tight by heat fusing the thermoplastic coating respective to continuous surfaces of said bottom panels; and embossing said bottom wall to a substantially concave surface shape with a set of embossing dies so that said bottom wall has at least three substantially parallel planar areas of concentrically diminishing areal magnitude aligned in a stepped sequence, while allowing the gas created by the embossing step to be vented through an air channel in at least one of said dies.

2. A method of fabricating a container as described by claim 1 wherein said plurality of planar surface areas are disposed in a stepped sequence of planar displacement.

* * * * *

UNITED STATES PATENT AND TRADEMARK OFFICE

CERTIFICATE OF CORRECTION

PATENT NO. : 5,683,339

DATED : Nov 4, 1997

INVENTOR(S) : Vincent Mills and Tim P. Hughes

It is certified that error appears in the above-identified patent and that said Letters Patent is hereby corrected as shown below:

Claim 1: Column 4, line 43, after "bottom" delete "peels" and insert --panels--.

Signed and Sealed this

Thirty-first Day of March, 1998

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,683,339

DATED : Nov. 4, 1997

INVENTOR(S) : Vincent Mills, et al

It is certified that error appears in the above-identified patent and that said Letters Patent is hereby corrected as shown below:

On title page, item [73] should read as follows:

--Assignee: International Paper Company, Purchase, New York--

Signed and Sealed this

Sixteenth Day of June, 1998

*Attest:*

BRUCE LEHMAN

*Attesting Officer*

*Commissioner of Patents and Trademarks*